US008740579B2

(12) United States Patent
Aritomi et al.

(10) Patent No.: US 8,740,579 B2
(45) Date of Patent: Jun. 3, 2014

(54) HIGH-PRESSURE FUEL SUPPLY PUMP AND DISCHARGE VALVE UNIT USED THEREIN

(75) Inventors: Shunsuke Aritomi, Mito (JP); Hideki Machimura, Tokai (JP); Kiyotaka Ogura, Hitachinaka (JP); Masami Abe, Kai (JP); Kenichiro Tokuo, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 632 days.

(21) Appl. No.: 12/674,145

(22) PCT Filed: Feb. 20, 2009

(86) PCT No.: PCT/JP2009/053077

§ 371 (c)(1),
(2), (4) Date: Feb. 11, 2011

(87) PCT Pub. No.: WO2010/095247

PCT Pub. Date: Aug. 26, 2010

(65) Prior Publication Data

US 2011/0123376 A1 May 26, 2011

(51) Int. Cl.
*F04B 49/00* (2006.01)

(52) U.S. Cl.
USPC ..... 417/311; 137/469

(58) Field of Classification Search
USPC ..... 417/311, 540, 542, 543; 123/502; 137/469
See application file for complete search history.

(56) References Cited

U.S. PATENT DOCUMENTS

| | | | | |
|---|---|---|---|---|
| 4,478,189 | A | 10/1984 | Fenne | |
| 4,706,705 | A * | 11/1987 | Lee, II | 137/514.5 |
| 4,986,728 | A | 1/1991 | Fuchs | |
| 6,210,127 | B1 * | 4/2001 | Hoshi et al. | 417/269 |
| 7,401,594 | B2 * | 7/2008 | Usui et al. | 123/467 |
| 7,527,035 | B2 * | 5/2009 | Schroeder | 123/446 |
| 2006/0147317 | A1 * | 7/2006 | Okamoto et al. | 417/297 |

FOREIGN PATENT DOCUMENTS

| | | | |
|---|---|---|---|
| CN | 88 1 00522 | A | 11/1988 |
| GB | 2 099 086 | A | 12/1982 |
| JP | 57-181969 | A | 11/1982 |
| JP | 58-90366 | U | 5/1983 |
| JP | 59-115461 | A | 7/1984 |
| JP | 05-22969 | U | 3/1993 |

(Continued)

OTHER PUBLICATIONS

Chinese Office Action dated Jan. 22, 2013 (ten (10) pages).
Japanese Office Action dated Jun. 5, 2012 (three (3) pages).

(Continued)

*Primary Examiner* — Devon Kramer
*Assistant Examiner* — Amene Bayou
(74) *Attorney, Agent, or Firm* — Crowell & Moring LLP

(57) ABSTRACT

A high-pressure fuel supply pump includes a discharge valve, which is a non-return valve between a pressurizing chamber and a discharge port. The discharge valve includes a valve body housing, a discharge valve spring, a valve body and a seat member. The discharge valve is a flat valve. When the valve is opened, a flow of fuel moving from the pressurizing chamber and axially colliding with the valve body is radially distributed in the radial direction of the valve body to become a flow directly moving the discharge ports and a flow colliding with an inner wall of the valve body housing before moving toward the discharge ports and then in a circumferential direction of the valve body.

6 Claims, 9 Drawing Sheets

(56) References Cited

FOREIGN PATENT DOCUMENTS

| | | | |
|---|---|---|---|
| JP | 05-66275 | U | 9/1993 |
| JP | 2004-218633 | A | 8/2004 |
| JP | 2006-207451 | A | 8/2006 |

OTHER PUBLICATIONS

International Search Report dated May 19, 2009 with partial English translation (four (4) pages).
PCT/IB/373 Form (One (1) page), dated Sep. 13, 2011.
PCT/ISA/237 Form (Three (3) pages), dated May 19, 2009.

* cited by examiner

HIGH-PRESSURE FUEL SUPPLY PUMP AND DISCHARGE VALVE UNIT USED THEREIN

TECHNICAL FIELD

The present invention relates generally to high-pressure fuel supply pumps for supplying fuel to an engine at high pressure and discharge valve units used therein, and in particular to a high-pressure fuel supply pump suitable for prevention of fluttering of a discharge valve and a discharge valve unit using the same.

BACKGROUND ART

In general, fluid-pressurizing equipment generates various noise such as hitting sound, pressure pulsation sound, etc., caused by its pressurizing operation. To deal with this, countermeasures have been taken to allow a hydraulic damper such as an accumulator or the like to absorb pressure pulsations generated or to allow a sound insulation material to absorb the noise generated. However, since the countermeasures are of post processing, they are disadvantageous in view of space-saving and cost reduction.

To eliminate the disadvantages, a valve structure which is provided with a noise reduction function in a valve unit has been studied.

For example, first, there is known a valve structure as below. In a check valve configured to radially discharge fuel from a plurality of discharge ports formed in a valve body housing, the valve structure is provided with a buffer portion which buffers the pressure of working liquid having passed through the discharge ports. (See e.g. patent document 1.)

Secondly, there is known a valve structure in which in a check valve, a valve seat is formed in a tapered shape so that discharge-flow may smoothly move from the valve seat to a discharge port so as to have a small directional change. In addition, a conical portion sitting on the valve seat is provided on a valve body. (See e.g. patent document 2.)

Patent Document 1: JP-5-66275-U-A

Patent Document 2: JP-5-22969-U-A

DISCLOSURE OF INVENTION

Problem to be Solved by the Invention

In the valves configured as described in patent documents 1 and 2, a flow axially colliding with the valve body when the valve is opened radially distributes in the radial direction of the valve body. Among the distributed flows, a flow in a range formed with the discharge ports moves toward the discharge ports without change and then becomes a flow in the valve body-radial direction. On the other hand, the flow moving toward a range not formed with the discharge ports collides with the inner wall of the valve body housing before it moves toward the discharge ports and becomes a valve body-circumferential flow.

In the valves described in patent documents 1 and 2, the flow moving toward the range not formed with the discharge ports becomes a high-pressure and high-speed flow in the circumferential direction of the valve body. This influence on the behavior of the valve body cannot be ignored, since such a flow produces behavior (hereinafter called fluttering) causing pressure pulsations.

In general, a ball valve used in a spherical valve body can provide a relatively large discharge flow rate while the axial displacement of the valve body is small. However, the relationship between the axial displacement and discharge amount of the valve body is nonlinear. In contrast to this, a flat valve is such that the relationship between the axial displacement and discharge amount of the valve body is linear. Incidentally, the flat valve is one in which a plane of a valve seat of the valve body is parallel to a plane perpendicular to the axial direction of the valve body. In addition, also a surface of a seat portion with which the valve body comes into contact is parallel to a plane perpendicular to the axial direction of the valve body. The valve described in patent document 1 is the flat valve. However, the flat valve needs to increase the axial displacement of the valve body in order to discharge a large flow rate. There is a clearance between the valve body and a valve body housing slidably supporting the valve body. If the valve body is radially offset from the center of the valve body housing, a significant difference in a sectional area through which a circumferential flow passes is produced between both sides of the valve body. Consequently, a differential pressure force applied to the valve body is increased to cause fluttering by such a differential pressure force acting as an exciting force. The fluttering is more liable to occur with the increased axial displacement of the valve body. Therefore, the flat valve discharging a large flow rate is likely to be problematic.

Fluttering is vibrations vertical to an opening and closing operating direction of the valve body. If this occurs, fuel around the valve body is influenced to cause pressure pulsations. The pressure pulsations thus caused are propagated and amplified through a piping system and discharged as noise to the outside. That is to say, they have a problem of producing noise.

It is an object of the present invention to provide a high-pressure fuel supply pump mounted with a discharge valve that can reduce an influence of noise caused by a valve body-circumferential flow and a discharge valve unit used therein.

Means for Solving the Problem (1) To achieve the above object, the present invention provides a high-pressure fuel supply pump including: a pressurizing chamber whose volume is varied by reciprocation of a plunger; a discharge port adapted to discharge fuel pressurized by the pressurizing chamber; and a discharge valve being a non-return valve provided between the discharge port and the pressurizing chamber. The discharge valve includes a valve body housing formed with a plurality of discharge ports communicating with the discharge port, a valve body accommodated in the valve body housing and biased in a direction of closing the valve by means of a discharge valve spring, and a seat member accommodated in the valve body housing and having a seat portion adapted to come into contact with the valve body for closing the valve. In the high-pressure fuel supply pump, the discharge valve is a flat valve in which a plane of a valve seat formed on the valve body and a plane of the seat portion are parallel to a plane perpendicular to an axial direction of the valve body. With this structure, when the valve is opened, a flow of fuel moving from the pressurizing chamber through a hollow portion of the seat member and axially colliding with the valve body is radially distributed in a radial direction of the valve body to become a flow directly moving the discharge ports and a flow colliding with an inner wall of the valve body housing before moving toward the discharge ports and then in a circumferential direction of the valve body. The discharge valve is provided with a liquid damper chamber defined between an outer circumference of the seat member and an outer circumference of the valve body and an inner circumference of the valve body housing to face the circumferential flow.

With such a configuration, an influence of noise caused by the valve body-circumferential flow can be reduced.

(2) In the above (1), preferably, the liquid damper chamber includes a first tubular passage defined between the outer circumference of the valve body and the inner circumference of the valve body housing, and a second tubular passage defined between the outer circumference of the seat member and the inner circumference of the valve body housing.

(3) In the above (2), preferably, the first and second tubular passages are such that a sectional area of the second tubular passage in a plane including an axis of the valve body is greater than that of the first tubular passage.

(4) In the above (3), preferably, an outer diameter of the valve body is greater than that of the valve seat.

(5) In the above (4), preferably, the first tubular passage is defined between a taper provided on the outer circumference of the valve seat of the valve body and the inner circumference of the valve body housing.

(6) In the above (2), preferably, a sectional area $\alpha$ of the fluid passage with respect to an opening area $\beta$ encountered when the discharge valve is fully opened is such that $\alpha>0.1\times\beta$.

(7) In the above (1), preferably, the liquid damper chamber is such that a sectional area in a plane including an axis of the valve body is greater than 0.3 $mm^2$.

(8) In addition, to achieve the above object, the present invention provides a discharge valve unit used in a high-pressure fuel supply pump adapted to discharge fuel pressurized by a pressurizing chamber from a discharge port through a discharge valve as a non-return valve, and press fitted in a valve body housing constituting part of the discharge valve. The discharge valve unit includes: a valve body biased in a direction of closing the valve by means of a discharge valve spring; and a seat member having a seat portion adapted to come into contact with the valve body for closing the valve. The discharge valve is a flat valve in which a plane of a valve seat formed on the valve body and a plane of the seat portion are parallel to a plane perpendicular to an axial direction of the valve body. With this structure, when the valve is opened, a flow of fuel moving from the pressurizing chamber through a hollow portion of the seat member and axially colliding with the valve body is radially distributed in a radial direction of the valve body to become a flow directly moving the discharge ports and a flow colliding with an inner wall of the valve body housing before moving toward the discharge ports and then in a circumferential direction of the valve body. The discharge valve is provided with a liquid damper chamber defined between an outer circumference of the seat member and an outer circumference of the valve body and an inner circumference of the valve body housing to face the circumferential flow.

With such a configuration, an influence of noise caused by the valve body-circumferential flow can be reduced.

Effect of the Invention

The present invention can reduce an influence of noise caused by the valve body-circumferential flow.

BEST MODE FOR CARRYING OUT THE INVENTION

A description will hereinafter be given of a configuration and operation of a high-pressure fuel supply pump according to a first embodiment of the present invention by use of FIGS. 1 to 7B.

First, a description is given of the configuration of a high-pressure fuel supply system using the high-pressure fuel supply pump according to the present embodiment by use of FIG. 1.

FIG. 1 is an overall configuration diagram of the high-pressure fuel supply system using the high-pressure fuel supply pump according to the first embodiment of the invention.

In FIG. 1, a portion enclosed by a broken line indicates a pump housing 1 of the high-pressure fuel supply pump. The pump housing 1 integrally incorporates mechanisms and parts shown in the broken line, which constitutes the high-pressure fuel supply pump of the present embodiment. In the figure, dotted lines indicate the flow of electric signals.

Fuel in a fuel tank 20 is pumped by a feed pump 21 and sent through an inlet pipe 28 to a fuel inlet port 10*a* of the pump housing 1. The fuel having passed through the fuel intake port 10*a* passes through a pressure pulsation reduction mechanism 9 and an intake passage 10*c* and reaches an intake port 30*a* of an electromagnetic intake valve mechanism 30 constituting a variable volume mechanism.

The electromagnetic suction valve mechanism 30 is provided with an electromagnetic coil 30*b*. During the energization of the electromagnetic coil 30*b*, an electromagnetic plunger 30*c* compresses a spring 33 and is shifted rightward in FIG. 1, the state of which is maintained. In this case, an inlet valve body 31 attached to a distal end of the electromagnetic plunger 30*c* opens an inlet port 32 communicating with a pressurizing chamber 11 of a high-pressure fuel supply pump. During the de-energization of the electromagnetic coil 30*b*, and there may be no fluid differential pressure between the inlet passage 10*c* (the inlet port 30*a*) and the pressurizing chamber 11, the biasing force of the spring 33 allows the inlet valve body 31 to be biased in a valve-closing direction (leftward in FIG. 3) to close the inlet port 32, the state of which is maintained. FIG. 1 illustrates the state where the inlet port 32 is closed.

In the pressurizing chamber 11, a plunger 2 is held in a vertically slidable manner in FIG. 1. When the rotation of a cam of an internal combustion engine displaces the plunger 2 to the lower portion of FIG. 1, providing an intake process, the volume of the pressurizing chamber 11 is increased to lower the fuel pressure therein. In this process, when the fuel pressure in the pressurizing chamber 11 is lower than that in the inlet passage 10*c* (the inlet port 30*a*), the inlet valve body 31 produces a valve-opening force (the force displacing the inlet valve body 31 rightward in FIG. 1) resulting from the fluid differential pressure of fuel. This valve-opening force allows the inlet valve body 31 to open the inlet port 32 while overcoming the biasing force of the spring 33. In this state, when a control signal from an ECU 27 is applied to the electromagnetic inlet valve mechanism 30, an electric current flows in the electromagnetic coil 30*b* of the electromagnetic inlet valve 30. This allows an electromagnetic biasing force to displace the electromagnetic plunger 30*c* rightward in FIG. 1, thereby keeping the inlet port 32 open.

While the electromagnetic inlet valve mechanism 30 is maintained in an input voltage-applied state, the plunger 2 is shifted from the intake process to a compression process (an elevation process from bottom dead center to top dead center). In this case, since the energization state of the electromagnetic coil 30*b* is maintained, the electromagnetic biasing force is maintained, which allows the inlet valve body 31 to remain maintaining its opened state. The volume of the pressurizing chamber 11 is reduced along with the compression movement of the plunger 2. In this state, the fuel having once been sucked in the pressurizing chamber 11 passes through again between the opened inlet valve body 31 and the inlet port 32 and is returned to the inlet passage 10*c* (the inlet port 30*a*). Therefore, the pressure of the pressurizing chamber 11 will not rise. This process is called a return process.

In the return process, when the electromagnetic coil 30*b* is de-energized, the electromagnetic biasing force applied to the electromagnetic plunger 30*c* is eliminated after a given length of time (magnetic, mechanical delay time). Then, the biasing force of the spring 33 constantly applied to the inlet valve body 31 and a fluidic force produced by the pressure loss of the inlet port 32 allows the inlet valve body 31 to be displaced leftward in FIG. 1, closing the inlet port 32. After the inlet port 32 is closed, the fuel pressure in the pressurizing chamber 11 rises along with the rise of the plunger 2. When the fuel pressure in the pressurizing chamber 11 exceeds that at the discharge port 13 by a certain value, the fuel left in the pressurizing chamber 11 is discharged at high pressure via the discharge valve 8 and supplied to a common rail 23. This process is called the discharge process. As described above, the compression process of the plunger 2 consists of the return process and the discharge process.

During the return process, the fuel returned to the inlet passage 10*c* causes pressure pulsations therein. However, the pressure pulsation only slightly flows back from the inlet port 10*a* to the inlet pipe 28 and a major portion of the returned fuel is absorbed by the pressure pulsation reduction mechanism 9.

The ECU 27 controls the timing of de-energization of the electromagnetic coil 30*c* included in the electromagnetic inlet valve mechanism 30, thereby controlling an amount of high-pressure fuel discharged. If the timing of the de-energization of the electromagnetic coil 30*b* is advanced, a proportion of the return process in the compression process can be reduced and a proportion of the discharge process can be increased. In other words, the fuel returned to the inlet passage 10*c* (the inlet port 30*a*) can be reduced and the fuel to be discharged at high pressure can be increased. In contrast to this, if the timing of the de-energization mentioned above is delayed, the proportion of the return process in the compression process is increased and the proportion of the discharge process can be reduced. In other words, the fuel returned to the intake passage 10*c* can be increased and the fuel discharged at high pressure can be reduced. The timing of the de-energization mentioned above is controlled by an instruction from the ECU 27.

As described above, the ECU 27 controls the timing of the de-energization of the electromagnetic coil, whereby the amount of fuel discharged at high pressure can be made to correspond to an amount required by the internal combustion engine.

In the pump housing 1, a discharge valve 8 is provided on an outlet side of the pressurizing chamber 11 between the outlet side and a discharge port (a discharge side pipe connection portion) 13. The discharge valve 8 includes a seat portion 8*a*, a valve body 8*b*, a discharge valve spring 8*c* and a valve body housing 8*d*. In a state where there is no differential pressure between the pressurizing chamber 11 and the discharge port 13, the valve body 8*b* is press fitted to the seat portion 8*a* by the biasing force of the discharge valve spring 8*c*, being in a valve-closed state. When the fuel pressure in the pressurizing chamber 11 exceeds the fuel pressure of the discharge port 13 by a given value, the valve body 8*b* is opened against the discharge valve spring 8*c*. This allows the fuel in the pressurizing chamber 11 to be discharged through the discharge valve 8 to the discharge port 13.

After being opened, the valve body 8*b* comes into contact with a stopper 805 formed on the valve body housing 8*d* so that its movement is limited. Therefore, the stroke of the valve body 8*b* is appropriately determined by the valve body housing 8*d*. If the stroke is too large, the closing-delay of the valve body 8*b* allows the fuel discharged to the discharge port 13 to flow back in the pressurizing chamber 11 again. Therefore, the efficiency as a high-pressure pump is lowered. The valve body 8*b* is guided by an inner wall 806 of the valve body housing 8*d* so as to smoothly move in a stroke direction when the valve body 8*b* repeats opening and closing movements. Because of the configuration as described above, the discharge valve 8 serves as a non-return valve for limiting the flowing direction of fuel. Incidentally, a detailed configuration of the discharge valve 8 is described later by use of FIGS. 2 to 5B.

As described above, a required amount of the fuel led to the fuel inlet port 10*a* is pressurized to high pressure at by the reciprocation of the plunger 2 in the pressurizing chamber 11 of the pump housing 1. The pressurized fuel is supplied under pressure through the discharge valve 8 and the discharge port 13 to the common rail 23, a high-pressure pipe.

The example has thus far been described of using the normal-close electromagnetic valve which is in the closed state during the de-energization and in the opened state during energization. In contrast to this, a normal-open electromagnetic valve may be used, which is in the opened state during the de-energization and in the closed state during energization. In this case, the flow rate control instruction from the ECU 27 is such that ON and OFF are reversed.

Injectors 24 and a pressure sensor 26 are mounted to the common rail 23. The number of the injectors 24 thus mounted is made equal to the number of cylinders of the internal combustion engine. In response to control signals of the ECU 27, the injectors 24 are each operatively opened and closed to inject a predetermined amount of fuel into a corresponding one of the cylinders.

A description is next given of a configuration of the discharge valve used in the high-pressure fuel supply pump according to the present embodiment by use of FIGS. 2 and 3.

FIGS. 2 and 3 are longitudinal cross-sectional views illustrating the configuration of the discharge valve used in the high-pressure fuel supply pump according to the first embodiment of the present invention. In FIGS. 2 and 3, a valve displacement direction is defined as a Z-axis and axes perpendicular to the Z-axis are defined as X- and Y-axes. FIG. 2 is a longitudinal cross-sectional view in a Z-Y plane, and FIG. 3 is a longitudinal cross-sectional view in a Z-X plane. FIGS. 2 and 3 illustrate the opened state of the discharge valve. Incidentally, in FIGS. 2 and 3, the same reference numerals as in FIG. 1 denote like portions.

The discharge valve 8 includes the seat portion 8*a*, valve body 8*b*, discharge valve spring 8*c* and valve body housing 8*d* described with FIG. 1. The seat portion 8*a*, valve portion 8*b*, discharge valve spring 8*c* and valve body housing 8*d* are each made of metal. The seat portion 8*a* is formed at one end of a seat member 8A. The valve body housing 8*d* and the seat member 8A are press fitted into and secured to the inside of the metal pump housing 1. The valve body 8*b* is slidably held inside the valve body housing 8*d*. In the figures, the Z-axial direction is a sliding direction of the valve body 8*b*. The discharge valve spring 8*c* is inserted between the valve body 8*d* and the valve body housing 8*d*. The discharge valve spring 8*c* biases the valve body 8*b* in a direction opposite to the fuel inflow direction. As described with FIG. 1, the pressurizing chamber 11 is provided inside the pump housing 1. The fuel pressurized in the pressurizing chamber 11 flows into the discharge valve 8 in the direction indicated by arrow A1. Thus, the Z-axial direction is the fuel inflow direction from the pressurizing chamber 11.

The valve body 8*b* and the valve body housing 8*d* are cylindrical. As shown in FIG. 2, the valve body housing 8*d* is formed with two discharge ports 803A and 803B opposed to each other on the sides of the seat portion 8*a*. The fuel discharged from the discharge ports 803A and 803B flows out from the discharge port 13 of the pump housing 1 in the arrow A2 direction and is supplied to the common rail 23 illustrated in FIG. 1. Incidentally, the discharge ports may be provided at three or more positions in the circumferential direction. The valve body housing 8*d* is formed with a guide circumferential surface 8*d*1 formed to extend rightward from a central portion as shown in FIG. 3, with a cut plane portion 8*d*2 in which a portion of the guide circumferential surface is cut in a planar manner as shown in FIG. 2, and with a flange portion 8*d*3 formed on the left side in the figures. On the other hand, the pump housing 1 is formed on an inner circumferential surface with a circumferentially stepped portion 1*a* with which the flange portion 8*d*3 of the valve body housing 8*d* comes into contact. The valve body housing 8*d* is press fitted into the inside of the pump housing 1 from the left side in FIG. 2 and is positioned by the flange portion 8*d*3 of the valve body housing 8*d* coming into contact with the circumferentially stepped portion 1*a*.

A right end face of the valve body housing 8*d* is formed with an equalizing hole 8*d*4. The equalizing hole 8*d*4 is a hole through which fluid comes in and goes out, the fluid having been discharged into a space on the back side of the valve body 8*b* receiving the spring 8*c* therein. This makes it possible for the discharge valve 8 to be smoothly moved by undergoing a differential pressure force resulting from a difference in pressure between the inside of the cylinder and the inside of the high-pressure pipe.

The valve body housing 8*d* is formed on an inner circumference with a cylindrical guide portion 8*d*5. A stepped portion 8*d*6 is formed on the right side of the cylindrical guide portion 8*d*5.

The valve body housing 8*d* is internally formed with a space adapted to receive the discharge valve spring 8*c* arranged therein. The discharge valve spring 8*c* is inserted inside the valve body housing 8*d* before the valve body 8*b* is inserted. When the valve body 8*b* is displaced rightward against the biasing force of the discharge valve spring 8*c*, the right end portion of the discharge valve spring 8*c* comes into contact with the stepped portion 8*d*6 to stop the displacement of the valve body 8*b*. In other words, the stepped portion 8*d*6 functions as the stopper 805 described in FIG. 1. The valve body 8*b* can reciprocate in the Z-axial direction while being guided by the guide portion 8*d*5. A slight clearance is provided between the outer circumference of the valve body 8*b* and the guide portion 8*d*5 so that the valve body 8*b* may be slidable. Therefore, while the valve body 8*b* is mainly reciprocated in the Z-axial direction, it can be displaced in a direction perpendicular to the Z-axis along with the reciprocation of the Z-axial direction. Thus, if the valve body 8*b* is offset from the guide portion 8*d*5, fluttering is likely to occur.

The left end face (the face opposite to the seat portion 8*a*) of the valve body 8*b* is a flat surface and is formed with a recessed portion 8*b*1 at its central portion. The circumference of the recessed portion 8*b*1 is a ringlike flat surface and serves as a valve seat 8*b*2.

The inner circumferential surface of the pump housing 1 is formed with a circumferential stepped portion 1*b* with which a flange portion 8A1 of the valve seat member 8A comes into contact. The valve seat member 8A is press fitted into the inside of the pump housing 1 from the left side in the figure and is positioned by the flange portion 8A1 of the valve seat member 8A coming into contact with the circumferential stepped portion 1*b*. The valve seat member 8A is internally hollow and the fuel pressurized in the pressurizing chamber 11 flows in the discharge valve 8. The right end face of the valve seat member 8A is of a ringlike flat surface and functions as the seat portion 8*a*. The valve seat 8*b*2 and the seat portion 9*a* are opposed to each other, and when both come into close contact with each other, the discharge valve 8 is closed. When both are away from each other, the discharge valve 8 is opened.

A surface of the valve seat 8*b*2 of the valve body 8*b* is parallel to a flat surface perpendicular to an axial direction (the reciprocating direction of the valve body 8*b*: the Z-axial direction) of the valve body 8*b*. Also a surface of the seat portion 8*a* with which the valve seat 8*b*2 comes into contact is parallel to a plane perpendicular to the axial direction of the valve body. The valve of the present embodiment is a flat valve.

A description is next given of a characteristic configuration of the discharge valve 8 of the present embodiment.

A tapered portion 801 is provided on the periphery of the valve seat 8*b*2 of the valve body 8*b*. Thus, an outer diameter of the valve body 8*b*, i.e., a diameter Rb2 of a portion of the valve body 8*b* adapted to be received by the guide portion 806 of the valve body housing 8*d* being inserted thereinto is made greater than an outer diameter Rb1 of the valve seat 8*b*2. With this configuration, a tubular clearance is defined between the outer circumference of the valve body 8*b* and the inner circumference of the valve body housing 8*d*. This tubular clearance is described later by use of FIG. 4. In other word, the tubular clearance is an annular clearance.

The valve seat member 8A is formed with a stepped portion 8A2 on the outer circumference thereof close to the seat portion 8*a*. Thus, an outer diameter Ra1 of the outer circumference of the valve seam member 8A close to the seat portion 8*a* is smaller than the left side outer diameter Ra2 of the valve seat member 8A. A projecting portion of the valve seat member 8A close to the seat portion 8*a* is located on the inner circumferential side of the valve body housing 8*d*. The outer diameter Ra1 of the outer circumference of the valve seam member 8A close to the seat portion 8*a* is made smaller than the inner diameter 8*d*1 of the valve body housing 8*d*. With this configuration, a tubular clearance is defined between the outer circumference of the valve seat member 8A and the inner circumference of the valve body housing 8*d*. This tubular clearance is described later by use of FIG. 4.

A description is next given of the tubular clearances provided in the discharge valve of the high-pressure fuel supply pump according to the first embodiment by use of FIGS. 4 and 5.

FIG. 4 is an enlarged cross-sectional view illustrating a configuration of an essential portion of the discharge valve used in the high-pressure fuel supply pump according to the first embodiment of the present invention. Incidentally, in FIG. 4, the same reference numerals as those in FIGS. 1 to 3 denote the identical portions. FIG. 5 includes views for assistance in explaining the flow of fuel in the discharge valve used in the high-pressure fuel supply pump according to the first embodiment of the invention.

As illustrated in FIG. 4, the tubular clearance 805B is defined between the outer circumference of the valve body 8*b* and the inner circumference of the valve body housing 8*d*. In addition, the tubular clearance 805C is defined between the outer circumference of the valve seat member 8A and the inner circumference of the valve body housing 8*d*. Further, since the clearance is present between the seat portion 8*a* and the valve seat 8*b*2 in the state where the discharge valve is opened, a tubular clearance 805A corresponding to this clearance is defined. In other word, these tubular clearances 805B and 805C are annular clearances.

These tubular clearances 805A, 805B and 805C communicate with one another. The sectional area of the conventional tubular clearance is equivalent to the sectional area of the tubular clearance 805A. In contrast to this, the sectional area of the tubular clearance of the present embodiment is equivalent to one obtained by adding together the sectional areas of the tubular clearance 805A, the tubular clearance 805B and the tubular clearance 805C. Therefore, the clearances thus added together can be made greater than ever before. In other words, the tubular clearances 805A, 805B and 805C constitute a liquid damper chamber. Incidentally, the sectional area means an area encountered when the cross-section of the discharge valve 8 is obtained on a plane including the axis (the Z-axis in the figure) of the valve body 8*b* as shown in the figures.

Referring to FIGS. 5A and 5B, a flow A1 axially colliding with the valve body 8*b* when the discharge valve is opened is radially distributed in the radial direction of the valve body. Among the radially distributed flows, as shown in FIG. 5A, flows A2 and A3 in respective ranges formed with the respective discharge ports 803A and 803B move toward the respective discharge ports 803A and 803B without change and then in the radial direction of the valve body. On the other hand, as shown in FIG. 5B, a flow A4 moving toward a range not formed with the discharge ports 803A and 803B collides with the inner wall of the valve body housing 8*d*, and thereafter moves toward the discharge ports 803A and 803B, becoming respective valve body-circumferential flows A5 and A6.

The valve body-circumferential flows A5 and A6 resulting from having collided with the inner wall of the valve body housing 8*d* shown in FIG. 5B and then moving toward the respective discharge ports 803A and 803B, pass through the liquid damper chamber described with FIG. 4 and move toward the respective discharge ports 803A and 803B. As a result, even if a pressure distribution around the valve body 8*b* causes bias, it can be alleviated by the liquid damper chamber.

It is assumed that the Z-axial length and width of the tubular clearance 805C defined between the outer circumference of the valve seat member 8A and the valve body housing 8*d* are z3 and x1, respectively. In this case, the sectional area of the tubular clearance 805C is x1·z3. In addition, it is assumed that the distance from one end to the other end of the tapered portion 801 of the valve body 8*b* is z2 and the width of the top of the taper is x1. In this case, the sectional area of the tubular clearance 805B is (x1·z2)/2. Further, if it is assumed that the stroke of the valve body 8*b* is ST1, this is equal to the length z1 of the tubular clearance 805A. If it is assumed that the length and width of the tubular clearance 805A are z1 and x1, respectively, the sectional area of the tubular clearance 805*a* is z1·x1.

The sectional area of the tubular clearance 805C is made greater than that of the tubular clearance 805B. A specific example is cited as below: x1=0.8 mm, z1=0.4 mm, z2=1.7 mm and z3=2.3 mm. In this case, the sectional area (1.8 $mm^2$) of the tubular clearance 805C is made greater than two times the sectional area (0.68 $mm^2$) of the tubular clearance 805B.

This is because of the following: if the sectional area of the tapered portion 801 is increased to increase the area of the tubular clearance 805B, the pressure-receiving area where the pressure pulsation in the tubular clearance 805B is applied to the valve body 8*b* is increased, which is disadvantageous in view of fluttering-suppression. In addition, if the valve body 8*b* is offset in a direction perpendicular to the sliding direction of the valve body, the sectional area per se of the tubular clearance 805B is decreasingly varied, which may degrade a function as a liquid damper.

In that respect, increasing the tubular clearance 805C solves these problems and can sufficiently increase the sectional area of the liquid damper chamber, which can reduce the pressure pulsation.

Incidentally, in the above-mentioned example, the sectional area of the tubular clearance 805A is 0.36 $mm^2$; thus, the liquid damper chamber is 2.84 $mm^2$. In a 4-cylinder engine of 1500 cc displacement, during an idling flow rate, in order to make a pressure loss equal to or lower than a predetermined value, it is necessary to make the cross-sectional area of the liquid damper chamber equal to or greater than 0.3 $mm^2$. As described above, the sectional area of only the tubular clearance 805A and the tubular clearance 805B resulting from the tapered portion 801 is 1.04 $mm^2$. It is sufficient, therefore, to reduce the pressure pulsation during the idling flow rate. However, the sectional area is not sufficient for the fuel flow rate during the maximum load of the engine. To deal with this, the addition of the tubular clearance 805C can sufficiently reduce the pressure pulsation also for the fuel flow rate during the maximum load of the engine.

Incidentally, examples of methods of defining the tubular clearance 805B include a method of providing a stepped portion on the valve body 8*b* as in an embodiment described later as well as the provision of the tapered portion 801 on the valve body 8*b*. However, for the stepped portion, a flow passing through the seat portion 8*a* and moving toward the discharge port 803 becomes a drastically enlarging flow, which may provably cause cavitation. In addition, for the stepped portion, also the flow direction is drastically changed; therefore, a head loss is large and unintended pressure pulsation occurs, which may be liable to promote fluttering.

In contrast to this, the provision of the tapered portion 801 of the valve body 8*b* as describe above can reduce the directional change of the discharge flow from the seat portion 8*a* toward the discharge port 803 while defining the tubular clearance 805B. This can make the flow smooth, which can suppress the occurrence of the unintended swirl and cavitation.

A sectional area $\alpha$ of a fluid passage with respect to an opening area $\beta$ encountered when the discharge valve is opened is such that $\alpha>0.1\times\beta$. The sectional area $\alpha$ of the fluid passage means the sectional area (0.33 $mm^2$) of the liquid damper chamber adapted to make a pressure loss equal to or lower than a predetermined value during the time of an idling flow rate of the 4-cylinder engine of 1500 cc displacement. The opening area $\beta$ encountered during the full opening of the discharge valve means a sectional area through which the flow moving toward the discharge port passes. Specifically, the opening area $\beta$ is such that {a clearance length (ST1=0.4 mm in FIG. 4) between the valve seat and the seat portion during the valve-opened}×{a length (3.75 mm) of a portion, opposite the discharge port, of the outer circumference of the valve seat}×2 (in the case where the number of the discharge ports are two), i.e., is equal to 3 $mm^2$. Thus, the sectional area $\alpha$ of the fluid passage with respect to the opening area $\beta$ encountered when the discharge valve is opened is such that $\alpha>0.1\times\beta$.

A description is next given of measurement results of discharge pressure of the high-pressure fuel supply pump according to the present embodiment by use of FIGS. 6A and 6B.

FIGS. 6A and 6B include explanatory views of the measurement results of the discharge pressure of the high-pressure fuel supply pump according to the first embodiment of the present invention.

FIG. 6A illustrates variations in the pressure P at the discharge port with respect to time t. Pressure P1 indicated with a thin solid line represents pressure variations at the discharge port of a high-pressure fuel supply pump having a conventional configuration. The conventional configuration means the case where the configuration illustrated in FIG. 4 does not have the tubular clearances 803B and 803C.

On the other hand, pressure P2 indicated with a thick solid line represents pressure variations at the discharge valve of the high-pressure supply pump according to the present embodiment described with FIGS. 1 to 4. The high-pressure supply pump of the present embodiment includes the tubular clearances 803B and 803C in addition to the tubular clearance 803A in the configuration illustrated in FIG. 4.

As illustrated in FIG. 6A, the present embodiment can reduce the pressure variations at the discharge port.

FIG. 6B represents frequencies f on a horizontal axis by obtaining pulsation amplitude V of the discharge port pressure by subjecting the pressure variations shown in FIG. 6A to Fourier transformation. Pulsation amplitude V1 indicated with a thin solid line is according to the conventional configuration, and pulsation amplitude V2 indicated with a solid line is according to the configuration of the present embodiment. In the figure, a range from frequency f1 to frequency f2 is a range of human's audibility. This is effective, particularly, in reducing the pulsation amplitude in the range of audibility, that is, noise can be reduced.

A description is next given of an assembling process of the discharge valve 8 of the present embodiment by use of FIG. 2.

The discharge valve 8 includes the seat member 8A having the seat portion 8*a* described with FIG. 2, valve body 8*b*, discharge valve spring 8*c* and valve body housing 8*d*. These parts are assembled inside the pump housing 1.

The assembly is performed from the left of the pump housing 1 shown in FIG. 2. As shown in FIG. 1, the electromagnetic inlet valve mechanism 30, the plunger 2 of the pressurizing chamber 11, etc., are assembled inside the pump housing 1. In the state before these parts are assembled, the pump housing 1 is provided with a bore adapted to receive the electromagnetic inlet valve mechanism 30 assembled thereinto. The parts of the discharge valve 8 are inserted through the bore via the inner space of the pressurizing chamber 11 and the discharge valve 8 is assembled in the right inner space of the pump housing 1 shown in FIG. 2.

First, the valve body housing 8*d* is press fitted and secured in the right inner space of the pump housing 1 shown in FIG. 2. In this case, the valve body housing 8*d* is press fitted in the pump housing 1 from the left direction in the figure and positioned by the flange portion 8*d*3 of the valve body housing 8*d* coming into contact with the circumferentially stepped portion 1*a*.

Next, the discharge valve spring 8*c* is inserted into the valve body housing 8*d*.

Next, the valve body 8*b* is inserted into the valve body housing 8*d*.

Lastly, the seat member 8A is press fitted in the pump housing 1 from the left direction in the figure and positioned by the flange portion 8A1 of the valve seat member 8A coming into contact with the circumferentially stepped portion 1*b*.

Incidentally, in the above description, the parts of the discharge valve 8 are sequentially assembled from the left side of FIG. 2, i.e., from the side of the pressurizing chamber 11; however, they may be assembled from the right side of FIG. 2 in some cases. In such cases, the pump housing 1 is formed, on the right side thereof, with a bore adapted to receive the seat member 8A insertable thereinto. The seat member 8A is press fitted through this bore and secured, next, the valve body 8*b* and the discharge valve spring 8*c* are sequentially inserted and lastly, the valve body housing 8*d* is press fitted and secured.

A description is next given of a configuration of a discharge valve unit used as the discharge valve of the high-pressure fuel supply pump according to the present embodiment by use of FIG. 7.

FIGS. 7A and 7B include cross-sectional views illustrating the configuration of the discharge valve unit used as the discharge valve of the high-pressure fuel supply pump according to the first embodiment of the invention. In FIGS. 7A and 7B, the displacement direction of the valve is defined as the Z-axial direction and axes perpendicular to the Z-axis are defined as X- and Y-axes. FIG. 7A is a longitudinal cross-sectional view in the Z-Y plane and FIG. 7B is a longitudinal cross-sectional view in the Z-X plane. FIGS. 7A and 7B illustrate the opened state of the discharge valve. Incidentally, in FIGS. 7A and 7B, the same reference numerals as in FIG. 1 denote like portions.

The spring 8*c* and the valve seat 8*b* are inserted in the valve body housing 8*d* before the stepped portion 8A3 of the valve seat portion 8*a* is press fitted in the inner circumferential surface of the valve body housing 8*d*. Thus, the discharge valve unit 8 is made as a single piece.

As illustrated in FIG. 2, the discharge valve unit 8U configured as above is integrally press fitted into the pump housing 1 from the side of the pressurizing chamber 11 on the left side in FIG. 2. Thus, the discharge valve can be configured. Alternatively, the discharge valve unit 8U is integrally press fitted into the pomp housing 1 from the right side of the pomp unit 1 in FIG. 2. Thus, the discharge valve can be configured.

As described above, according to the present embodiment, of the flows axially having collided with the valve body and radially distributed, the flow moves toward the range not formed with the discharge ports can be made to move toward the discharge port through the fluid passage forming the circumferential liquid damper chamber. Thus, the flow can be led positively and smoothly. As a result, the bias in the pressure distribution around the valve body can be eliminated to reduce the differential pressure force applied to the valve body, which can suppress fluttering.

The circumferential fluid passage (the tubular passage 805C) having a sectional area equal to or greater than a predetermined value is previously formed. Therefore, even if the valve body is offset in the radial direction from the center of the valve body housing, a sectional area variation before and after the offset can be kept small. Consequently, differential pressure occurring between both the sides of the valve body can be reduced, which can suppress fluttering.

Further, a portion of the fluid passage is formed of the front surface of the member other than the valve body. Therefore, without an increase in the pressure receiving area where the pressure pulsations in the fluid passage are applied to the valve body, the fluid passage is increased in sectional area to achieve the sufficient function of circumferentially guiding fluid. In addition, although the pressure pulsations occur in the fluid passage, an influence on the behavior of the valve body can be minimized, which can suppress fluttering.

Specifically, since the pressure pulsations in a frequency range where a human's ear has high sensitivity are reduced, noise produced along with high pressurization and an increased flow rate can be reduced while avoiding or suppressing increased cost and the like resulting from the enlargement of an external shape and the complicated layout of high-pressure piping.

As described above, it is possible to reduce an influence of noise caused by the valve body-circumferential flow.

Incidentally, the tubular valve body and valve body housing are used in the above-description. However, also valves having shapes other than such a tubular shape are formed with the circumferential fluid passage by the same method, which can suppress the fluttering of the valve body.

A description is next given of a configuration and operation of a high-pressure fuel supply pump according to a second embodiment of the present invention by use of FIG. 8. Incidentally, the configuration of the high-pressure fuel supply system using the high-pressure supply pump according to the present embodiment is the same as that illustrated in FIG. 1.

FIG. 8 is a longitudinal cross-sectional view illustrating the configuration of a discharge valve used in the high-pressure fuel supply pump according to a second embodiment of the present invention. FIG. 8 illustrates an opened state of the discharge valve. Incidentally, in FIG. 8, the same reference numerals as in FIGS. 1-4 denote the identical portions.

Also in the present embodiment, a discharge valve 8 includes a seat portion 8*a*, a valve body 8*b*, a discharge valve spring 8*c* and a valve body housing 8*d*. The valve body 8*b* and the valve body housing 8*d* are cylindrical. Discharge ports 803A and 803B are formed at two respective positions laterally of the seat portion 8*a* so as to be opposed to each other. Incidentally, the discharge ports may be provided at three respective circumferential positions.

In the present embodiment, the outer diameter of the valve body 8*b*, i.e., the diameter of a portion inserted into a guide portion 8*d*5 of the valve body housing 8*d* is greater than the outer diameter of the seat portion 8*a*. A stepped portion 802 is formed on the periphery of the valve seat 8*b*2 of the valve body 8*b*.

With such a configuration, a tubular clearance 805B is defined between the valve body 8*b* and the valve body housing 8*d*. Thus, among discharge flows radially distributed after collision with the valve body 8*b*, flows moving toward a range not formed with the discharge ports 803A and 803B are made to turn in the circumferential direction of the valve body 8*b*. This can smoothly lead the flows to the nearest discharge ports 803A and 803B. As a result, bias of a pressure distribution around the valve body 8*b* can be alleviated.

In addition, similarly to the first embodiment described with FIG. 4, a tubular clearance 805C is formed between the outer circumferential portion of the seat portion 8*a* and the inner diameter portion of the valve body housing 8*d*. The provision of the tubular clearance 805C in addition to the tubular clearance 805B can ensure a sufficient sectional area without an increase in the pressure receiving area where the pressure pulsations in the tubular clearance are applied to the valve body 8*b*. This can suppress the fluttering of the valve body 8*b* to reduce noise. The sectional area of the tubular clearance 805C is made greater than that of the tubular clearance 805B. Therefore, the pressure receiving area to which the pressure pulsations are applied can be reduced.

With the configuration described above, also the present embodiment can reduce the influence of noise caused by the valve body-circumferential flow.

Incidentally, the tubular valve body and valve body housing are used in the above-description. However, also valves having shapes other than such a tubular shape are formed with the circumferential fluid passage by the same method, which can suppress the fluttering of the valve body.

A description is next given of a configuration and operation of a high-pressure fuel supply pump according to a third embodiment of the present invention by use of FIG. 9. Incidentally, the configuration of the high-pressure fuel supply system using the high-pressure fuel supply pump according to the present embodiment is the same as that illustrated in FIG. 1.

FIG. 9 is a longitudinal cross-sectional view illustrating the configuration of a discharge valve used in the high-pressure fuel supply pump according to the third embodiment of the present invention. FIG. 9 illustrates an opened state of the discharge valve. Incidentally, in FIG. 9, the same reference numerals as in FIGS. 1 to 4 denote the identical portions.

The present embodiment uses a plate-like valve body 8*b* not provided with the guide portion 806 in the embodiments illustrated in FIGS. 2 and 8. The use of the plate-like valve body 8*b* facilitates a configuration and processing and is advantageous in cost reduction, compared with the case using the valve body with guide portion as in the embodiments illustrated in FIGS. 2 and 8. However, since a mechanism of suppressing unintentionally occurring behavior of the valve body is not provided, it is essential to suppress fluttering in view of operation reliability as well as of noise reduction.

Similarly to the case of the valve body with guide portion, the valve body 8*b* is formed to have an outer diameter greater than that of the seat portion 8*a* and provided with a tapered portion 807. Thus, the tubular clearance 805B is defined, which can produce the circumferentially smooth flow, thereby reducing the bias of the pressure distribution. The provision of the tapered portion 807 can reduce a directional variation of a main flow in the radial direction moving toward the discharge ports 803A, 803B for smoothness.

According to the configuration described above, also the present embodiment can reduce the influence of noise caused by the valve body-circumferential flow.

Incidentally, the present invention can widely be used in various high-pressure pumps as well as in the high-pressure fuel supply pump of an internal combustion engine.

EXPLANATION OF REFERENCE NUMERALS

Figure 1:
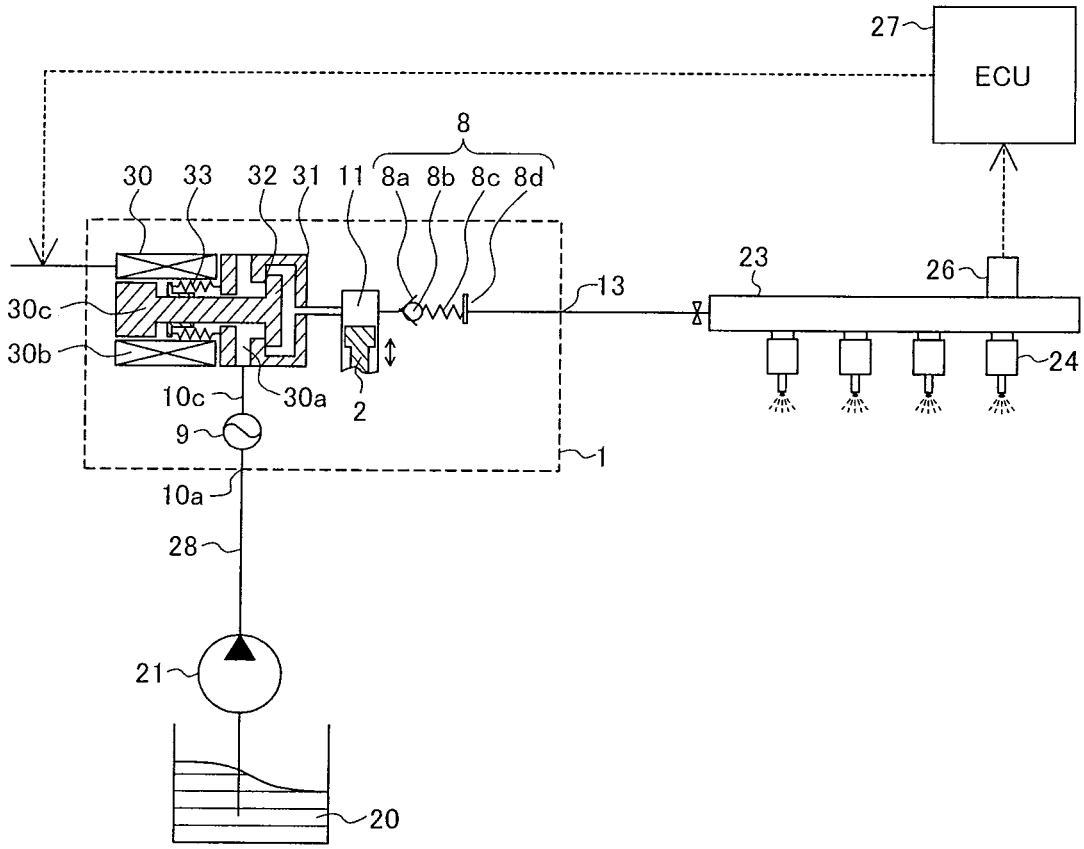
FIG. 1 is an overall configuration diagram of a high-pressure fuel supply system using a high-pressure fuel supply pump according to a first embodiment of the present invention.
Figure 2:
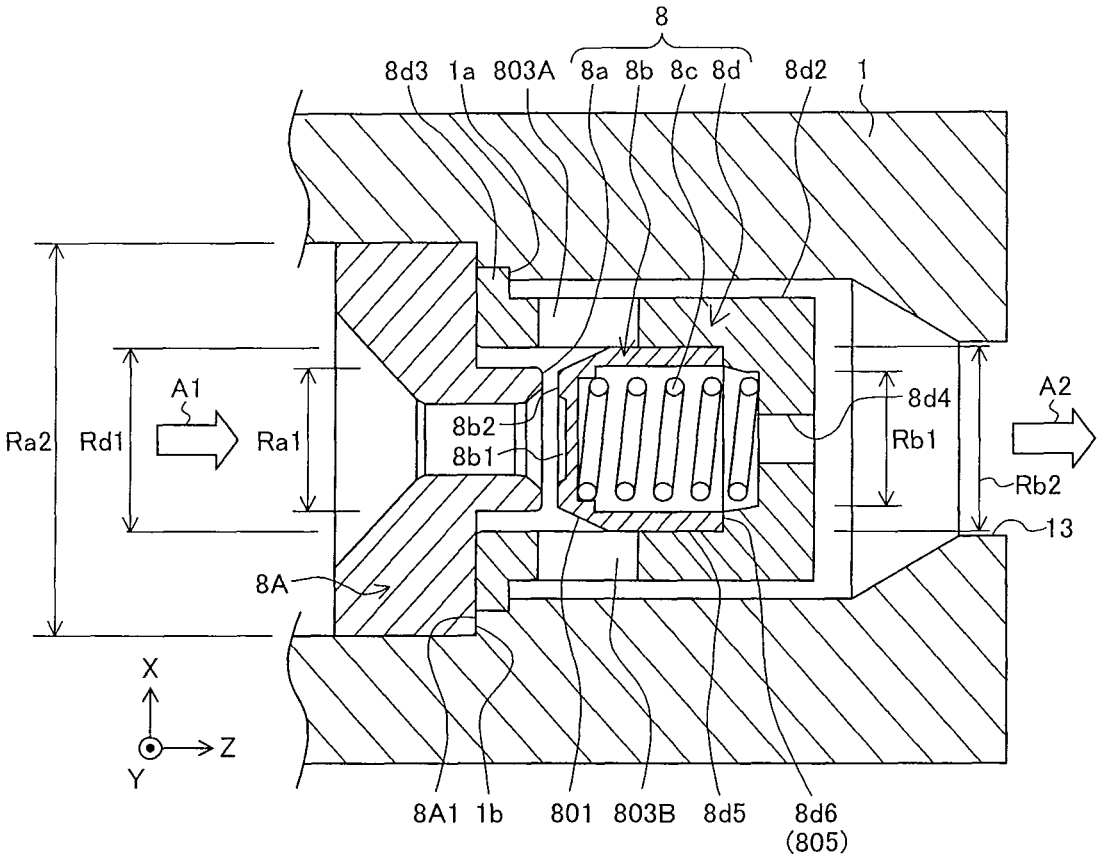
FIG. 2 is a longitudinal cross-sectional view illustrating a configuration of a discharge valve used in a high-pressure fuel supply pump according to the first embodiment of the invention.
Figure 3:
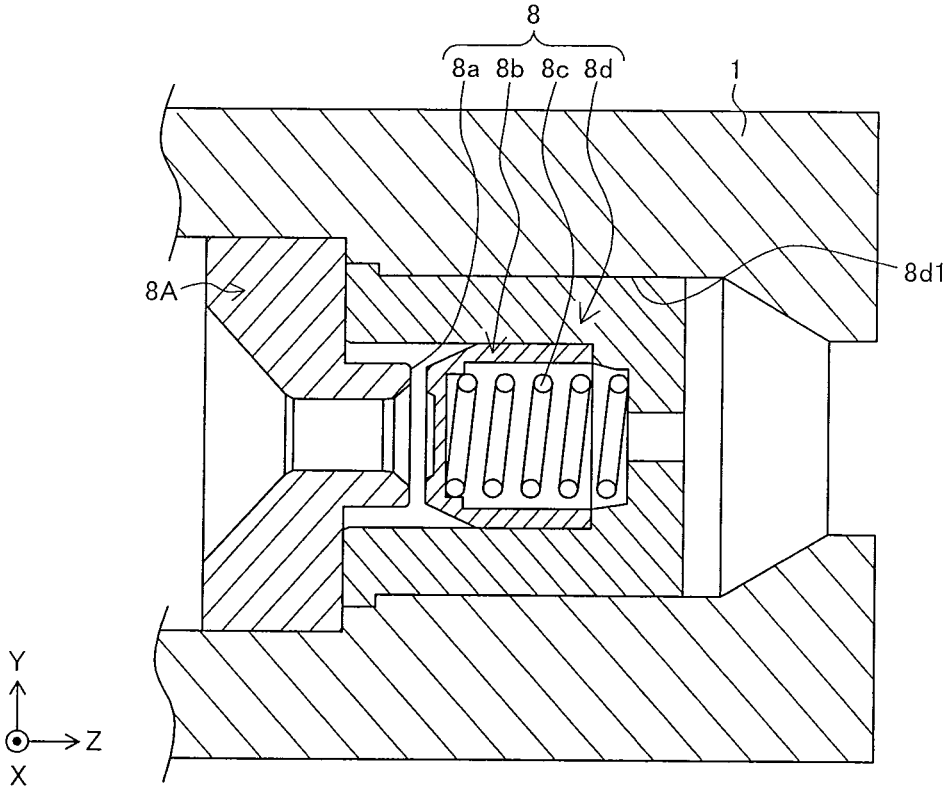
FIG. 3 is a longitudinal cross-sectional view illustrating the configuration of the discharge valve used in the high-pressure fuel supply pump according to the first embodiment of the invention
Figure 4:
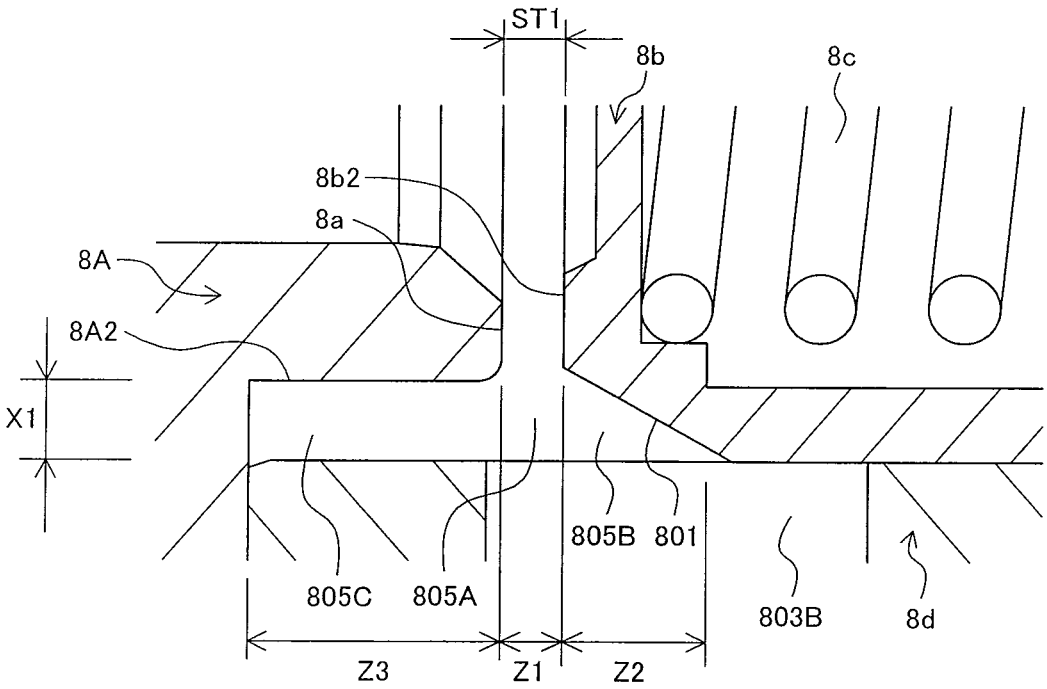
FIG. 4 is an enlarged cross-sectional view illustrating a configuration of an essential portion of the discharge valve used in the high-pressure fuel supply pump according to the first embodiment of the present invention.
Figure 5A:
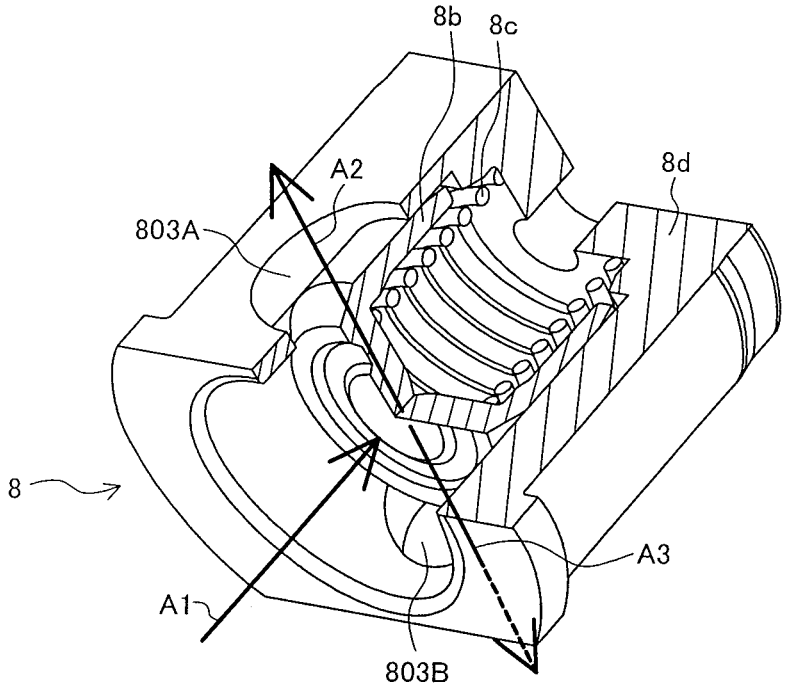
FIG. 5A is an explanatory view for flow of fuel in the discharge valve used in the high-pressure fuel supply pump according to the first embodiment of the present invention.
Figure 5B:
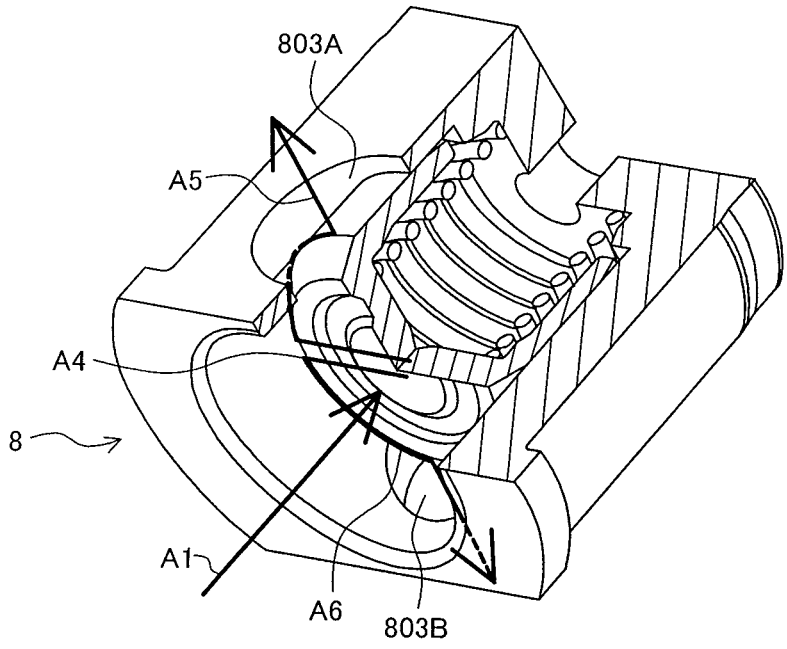
FIG. 5B is an explanatory view for flow of fuel in the discharge valve used in the high-pressure fuel supply pump according to the first embodiment of the present invention.
Figure 6A:
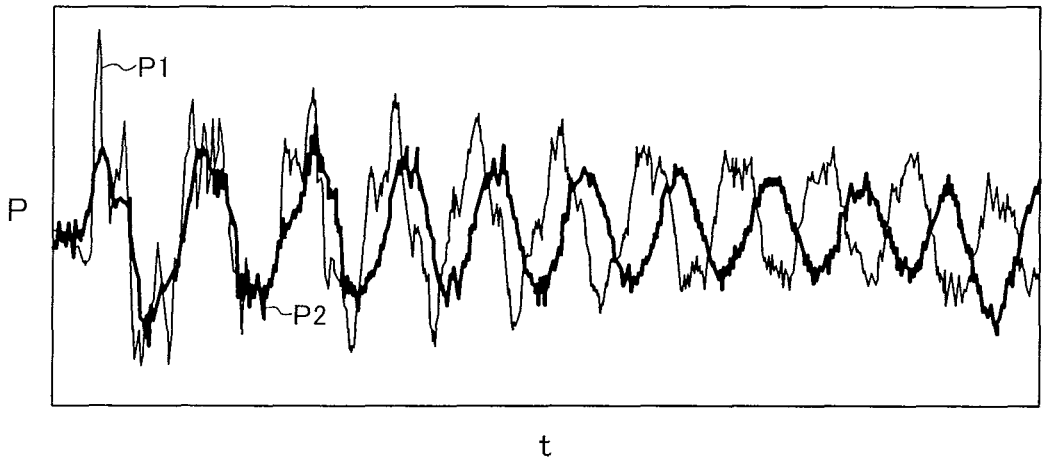
FIG. 6A is an explanatory view for measurement results of discharge pressure of the high-pressure fuel supply pump according to the first embodiment of the present invention.
Figure 6B:
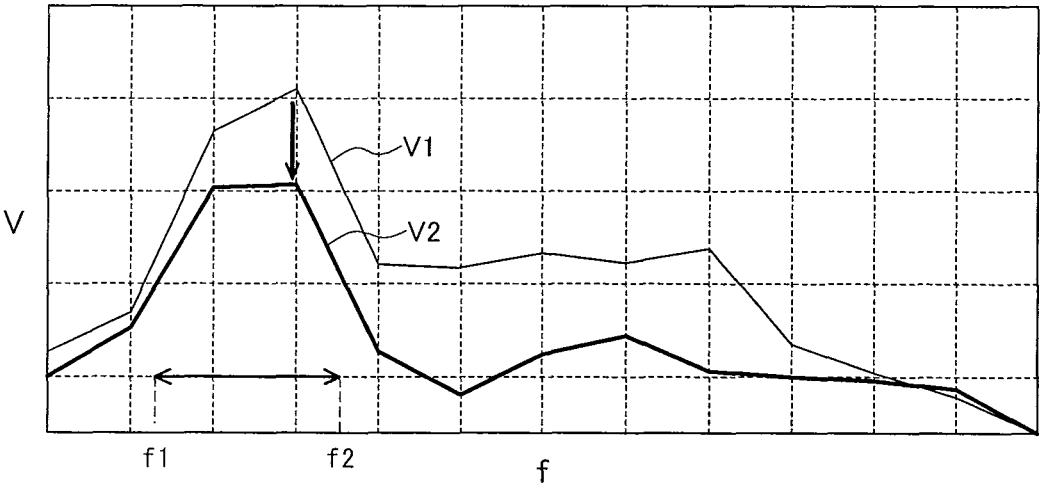
FIG. 6B is an explanatory view for measurement results of discharge pressure of the high-pressure fuel supply pump according to the first embodiment of the present invention.
Figure 7A:
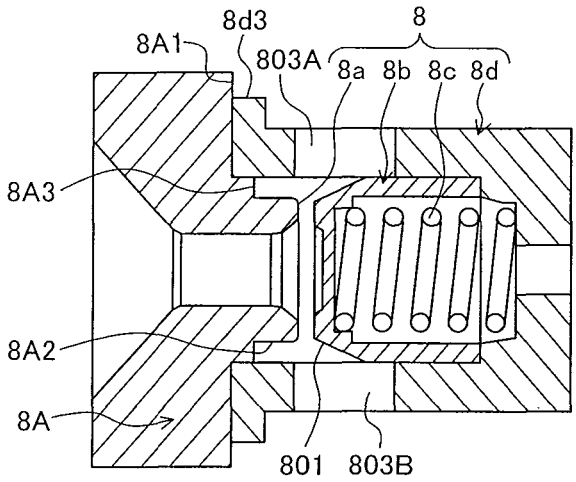
FIG. 7A is a cross-sectional view illustrating a configuration of a discharge valve unit used as a discharge valve of a high-pressure fuel supply pump according to the first embodiment of the present invention.
Figure 7B:
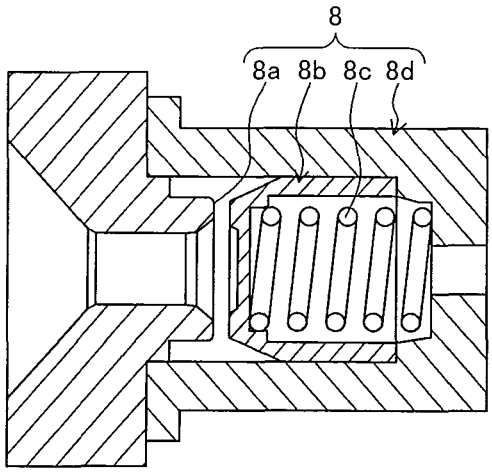
FIG. 7B is a cross-sectional view illustrating a configuration of a discharge valve unit used as a discharge valve of a high-pressure fuel supply pump according to the first embodiment of the present invention.
Figure 8:
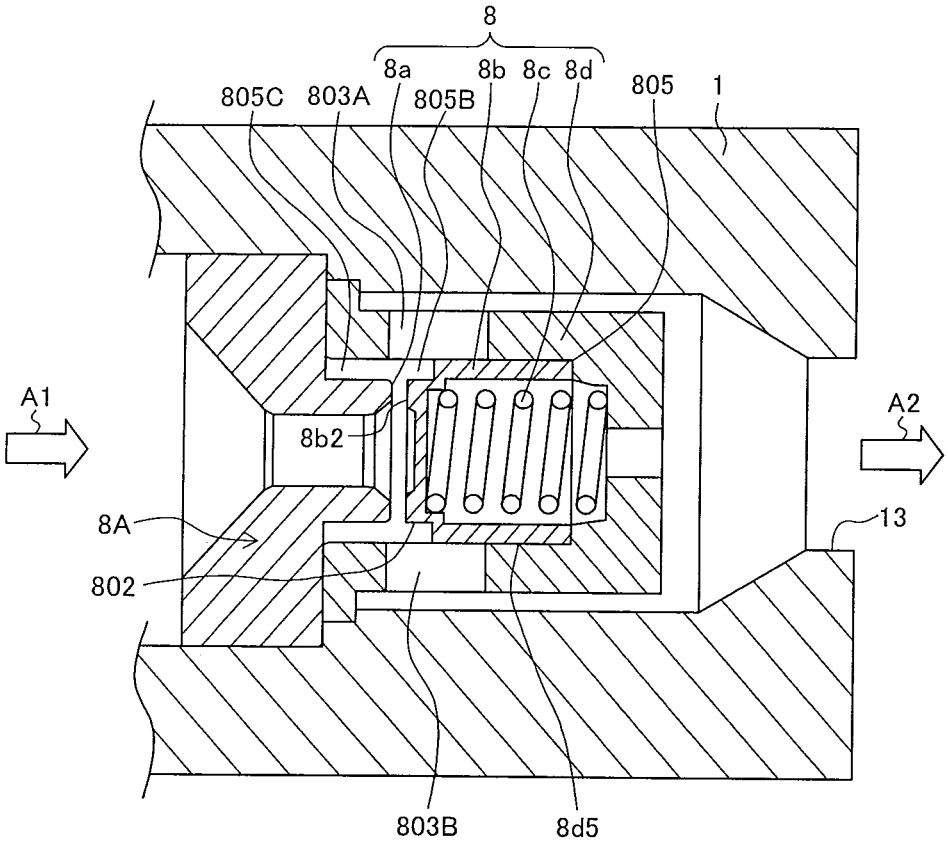
FIG. 8 is a longitudinal cross-sectional view illustrating a configuration of the discharge valve used in the high-pressure fuel supply pump according to a second embodiment of the present invention.
Figure 9:
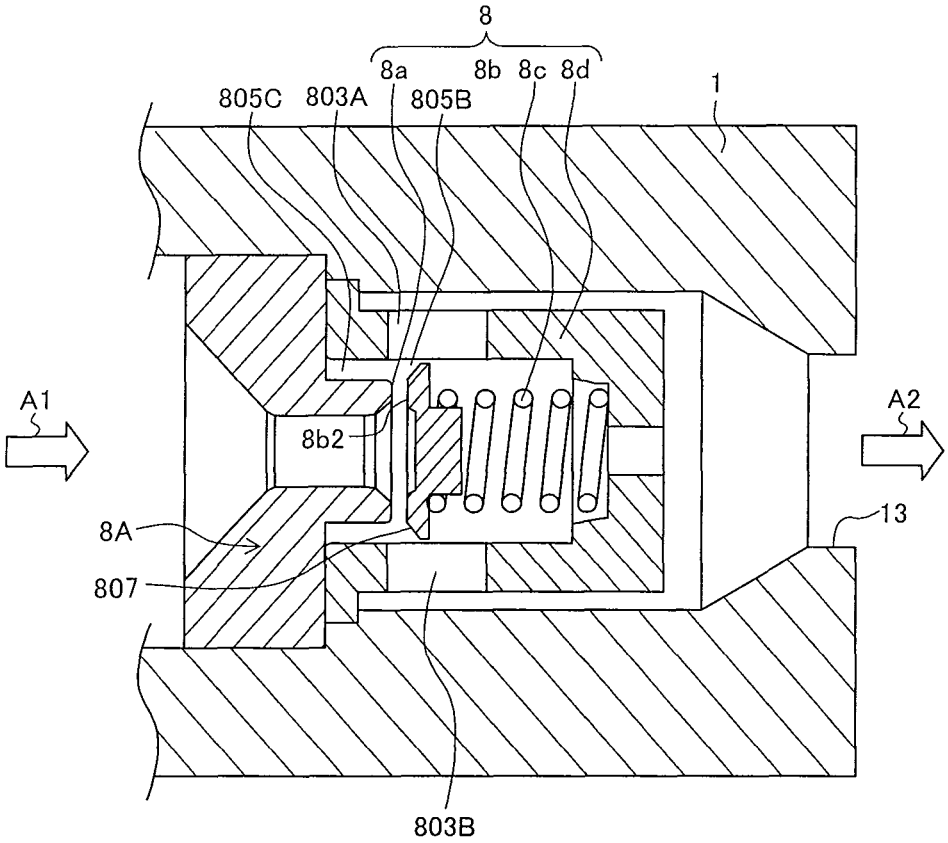
FIG. 9 is a longitudinal cross-sectional view illustrating a configuration of the discharge valve used in the high-pressure fuel supply pump according to a third embodiment of the present invention.

1 . . . Pump housing
1*a*, 1*b* . . . Circumferential stepped portion
2 . . . Plunger
8 . . . Discharge valve
8A . . . Seat member
8A1 . . . Flange portion
8A2 . . . Stepped portion
8*a* . . . Seat portion
8*b* . . . Valve body 8*b*
8*b*1 . . . Recessed portion
8*b*2 . . . Valve seat
8*c* . . . Discharge valve spring
8*d* . . . Valve body housing
8*d*1 . . . Guide circumferential surface
8*d*2 . . . Cut plane surface
8*d*3 . . . Flange portion
8*d*4 . . . Equalizing hole
8*d*5 . . . Guide portion
8*d*6 . . . Stepped portion
9 . . . Pressure pulsation reduction mechanism
10*c* . . . Inlet passage
11 . . . Pressurizing chamber
13 . . . Discharge port
20 . . . Fuel tank
23 . . . Common rail
24 . . . Injector
26 . . . Pressure sensor
27 . . . ECU
30 . . . Electromagnetic inlet valve mechanism
801, 807 . . . Tapered portion
802 . . . Stepped portion
803A, 803B . . . Discharge port
805 . . . Liquid damper chamber
805A, 805B, 805C . . . Tubular passage

The invention claimed is:

1. A high-pressure fuel supply pump comprising:

a pressurizing chamber whose volume is varied by reciprocation of a plunger;

a discharge port adapted to discharge fuel pressurized by the pressurizing chamber; and a discharge valve being a non-return valve provided between the discharge port and the pressurizing chamber, the discharge valve including:

a valve body housing formed with a plurality of discharge ports communicating with the discharge port;

a valve body accommodated in the valve body housing and biased in a direction of closing the valve by means of a discharge valve spring; and a seat member accommodated in the valve body housing and having a seat portion adapted to come into contact with the valve body for closing the valve, wherein the discharge valve is a flat valve in which a plane of a valve seat formed on the valve body and a plane of the seat portion are parallel to a plane perpendicular to an axial direction of the valve body, wherein, when the valve is opened, a flow of fuel moving from the pressurizing chamber through a hollow portion of the seat member and axially colliding with the valve body is radially distributed in a radial direction of the valve body to become a flow directly moving towards the discharge ports and a flow colliding with an inner wall of the valve body housing before moving toward the discharge ports and then in a circumferential direction of the valve body, and wherein the discharge valve is provided with a liquid damper chamber defined between an outer circumference of the seat member and an outer circumference of the valve body, and an inner circumference of the valve body housing to face the flow in the circumferential direction, wherein the liquid damper chamber includes a first tubular passage defined between the outer circumference of the valve body and the inner circumference of the valve body housing, and a second tubular passage defined between the outer circumference of the seat member and the inner circumference of the valve body housing.

2. The high-pressure fuel supply pump according to claim 1, wherein the first and second tubular passages are such that a sectional area of the second tubular passage in a plane including an axis of the valve body is greater than that of the first tubular passage.

3. The high-pressure fuel supply pump according to claim 2, wherein an outer diameter of the valve body is greater than that of the valve seat.

4. The high-pressure fuel supply pump according to claim 3, wherein the first tubular passage is defined between a tapered portion provided on the outer circumference of the valve seat of the valve body and the inner circumference of the valve body housing.

5. The high-pressure fuel supply pump according to claim 1, wherein the liquid damper chamber is such that a sectional area in a plane including an axis of the valve body is greater than 0.3 $mm^2$.

6. A discharge valve unit used in a high-pressure fuel supply pump adapted to discharge fuel pressurized by a pressurizing chamber from a discharge port through a discharge valve as a non-return valve, and press fitted in a valve body housing constituting part of the discharge valve, the discharge valve unit comprising:

a valve body biased in a direction of closing the valve by means of a discharge valve spring; and a seat member having a seat portion adapted to come into contact with the valve body for closing the valve, wherein the discharge valve is a flat valve in which a plane of a valve seat formed on the valve body and a plane of the seat portion are parallel to a plane perpendicular to an axial direction of the valve body, wherein, when the valve is opened, a flow of fuel moving from the pressurizing chamber through a hollow portion of the seat member and axially colliding with the valve body is radially distributed in a radial direction of the valve body to become a flow directly moving towards the discharge ports and a flow colliding with an inner wall of the valve body housing before moving toward the discharge ports and then in a circumferential direction of the valve body, wherein the discharge valve is provided with a liquid damper chamber defined between an outer circumference of the seat member and an outer circumference of the valve body, and an inner circumference of the valve body housing to face the circumferential flow, and wherein the liquid damper chamber includes a first tubular passage defined between the outer circumference of the valve body and the inner circumference of the valve body housing, and a second tubular passage defined between the outer circumference of the seat member and the inner circumference of the valve body housing.

* * * * *